US009470484B2

(12) United States Patent
Benson

(10) Patent No.: US 9,470,484 B2
(45) Date of Patent: Oct. 18, 2016

(54) FOAM EXPLOSIVE CONTAINERS

(76) Inventor: Mark Benson, San Diego, CA (US)

( * ) Notice: Subject to any disclaimer, the term of this patent is extended or adjusted under 35 U.S.C. 154(b) by 0 days.

(21) Appl. No.: 14/009,872

(22) PCT Filed: Apr. 6, 2012

(86) PCT No.: PCT/US2012/032585

§ 371 (c)(1),
(2), (4) Date: Aug. 12, 2014

(87) PCT Pub. No.: WO2013/002867

PCT Pub. Date: Jan. 3, 2013

(65) Prior Publication Data

US 2014/0352568 A1 Dec. 4, 2014

Related U.S. Application Data

(60) Provisional application No. 61/473,045, filed on Apr. 7, 2011.

(51) Int. Cl.

| | |
|---|---|
| ***F42B 39/00*** | (2006.01) |
| ***F42B 39/14*** | (2006.01) |
| ***F42B 3/26*** | (2006.01) |
| ***F42B 3/00*** | (2006.01) |
| ***F42B 3/02*** | (2006.01) |
| ***F42B 3/28*** | (2006.01) |

(52) U.S. Cl.

CPC . *F42B 3/26* (2013.01); *F42B 3/00* (2013.01); *F42B 3/02* (2013.01); *F42B 3/28* (2013.01); *F42B 39/002* (2013.01); *F42B 39/14* (2013.01)

(58) Field of Classification Search

CPC ..... F42B 33/00; F42B 33/02; F42B 33/04; F42B 33/06; F42B 3/00; F42B 1/00; F42B 39/14; F42B 39/24; F42B 39/26; F42B 39/30

USPC ..... 86/50; 89/1.1, 36.01; 206/3; 109/49.5

See application file for complete search history.

(56) References Cited

U.S. PATENT DOCUMENTS

| | | | | | |
|---|---|---|---|---|---|
| 3,593,873 | A | * | 7/1971 | Vonk | 220/507 |
| 3,603,107 | A | * | 9/1971 | Elliott et al. | 62/459 |
| 3,721,201 | A | * | 3/1973 | Boller | 109/49.5 |
| 3,739,731 | A | * | 6/1973 | Tabor | 109/49.5 |
| 3,786,956 | A | * | 1/1974 | Tabor | 220/560.01 |

(Continued)

FOREIGN PATENT DOCUMENTS

| | | | | | |
|---|---|---|---|---|---|
| FR | 2763924 | A1 | * | 12/1998 | B65F 1/14 |
| RU | 2149347 | C1 | | 5/2000 | |
| RU | 2350894 | C1 | | 3/2009 | |

*Primary Examiner* — Jonathan C Weber

(74) *Attorney, Agent, or Firm* — Gorman IP Law, APC

(57) ABSTRACT

A lightweight explosive containment device that is used to transport blasting caps, explosive precursors, or homemade explosives. Open cellular foam material within the container diffuses explosive gases and absorbs kinetic energy. An internal clapper tube distributes forces to the ligaments of the cellular foam material and an external support tube contains the explosive fragmentation and blast overpressure. A system of containers with storage capabilities that enable the transportation of a number of lightweight explosive containment devices is presented. An alternate configuration of the present invention utilizes the open cellular foam material to create a directional disruption device. Such a tool prevents explosive gases and fragmentation from causing unnecessary collateral damage to the surroundings or supporting robot.

17 Claims, 5 Drawing Sheets

(56) References Cited

U.S. PATENT DOCUMENTS

| | | | | | |
|---|---|---|---|---|---|
| 3,800,715 | A | * | 4/1974 | Boller | 109/49.5 |
| 4,027,601 | A | * | 6/1977 | Hickerson | 109/1 R |
| 4,055,247 | A | * | 10/1977 | Benedick et al. | 206/3 |
| 4,100,860 | A | * | 7/1978 | Gablin et al. | 109/83 |
| 4,210,082 | A | * | 7/1980 | Brothers | 102/401 |
| 4,347,929 | A | | 9/1982 | Poe | |
| 4,432,285 | A | * | 2/1984 | Boyars et al. | 109/49.5 |
| H314 | H | * | 8/1987 | Betts | 206/523 |
| 4,768,418 | A | * | 9/1988 | Blommer et al. | 89/34 |
| 4,942,991 | A | * | 7/1990 | Lyons | 224/196 |
| 4,989,493 | A | * | 2/1991 | Blommer et al. | 102/374 |
| 5,157,223 | A | * | 10/1992 | Wheeler et al. | 102/374 |
| 5,158,173 | A | * | 10/1992 | Halsey et al. | 206/3 |
| 5,160,468 | A | * | 11/1992 | Halsey et al. | 264/112 |
| 5,212,337 | A | * | 5/1993 | Patteri et al. | 89/34 |
| 5,668,342 | A | * | 9/1997 | Discher | 86/50 |
| 5,873,455 | A | * | 2/1999 | Capers, III | 206/3 |
| 6,196,107 | B1 | * | 3/2001 | Hoffman et al. | 86/50 |
| 6,269,725 | B1 | | 8/2001 | Cherry | |
| 6,386,296 | B1 | | 5/2002 | Kothari et al. | |
| 7,229,735 | B2 | | 6/2007 | Pickering | |
| 7,343,843 | B2 | * | 3/2008 | Sharpe et al. | 86/50 |
| 7,395,922 | B1 | * | 7/2008 | Sinha | 206/3 |
| 2003/0209133 | A1 | * | 11/2003 | Greenfield et al. | 86/50 |
| 2005/0150781 | A1 | * | 7/2005 | Barton et al. | 206/3 |
| 2005/0242093 | A1 | * | 11/2005 | Sharpe et al. | 220/62.11 |
| 2005/0252915 | A1 | * | 11/2005 | Schmidt et al. | 220/88.1 |
| 2007/0119851 | A1 | * | 5/2007 | James | 220/88.1 |
| 2007/0131684 | A1 | * | 6/2007 | Cirillo et al. | 220/88.1 |
| 2011/0174639 | A1 | * | 7/2011 | Sibley | 206/3 |

* cited by examiner

FOAM EXPLOSIVE CONTAINERS

CROSS-REFERENCE TO RELATED APPLICATIONS

This Nonprovisional application claims priority under 35 U.S.C. §119(e) on U.S. Provisional Application No. 61/473,045 filed on Apr. 7, 2011, the entire contents of which are hereby incorporated by reference in its entirety.

TECHNICAL FIELD

Embodiments of the present invention relate to the technical field of explosives. More particularly, the embodiments of the present invention are directed to explosive blast containment.

BACKGROUND OF THE INVENTION

Explosive containment devices are high strength pressure vessels used to contain the blast of explosives. Explosive containment devices are available in a number of sizes and are designed in order to meet a specific net explosive weight (NEW) for the items placed within them. Containers are often constructed of heavy walled alloys and may include carbon composites, polymers, and/or other materials in order to contain the blast overpressure and fragmentation associated with the detonation of explosives.

Personnel who work with explosives, or who respond to explosive response operations, often utilize explosive containment devices in order to store and transport explosive materials. Explosive containment devices reduce the risk of injury or death that may occur as the result of an incidental or unintentional detonation. Damage of property is also minimized.

One hazardous explosive that is commonly stored in an explosive containment device is a blasting cap. Blasting caps are highly sensitive explosives used to create an explosive chain reaction in order to detonate a more stable but powerful main charge. Due to their sensitivity, blasting caps demand the highest safety considerations for personnel utilizing them and the explosives within the blasting caps can be powerful enough to sympathetically detonate other explosives within their vicinity if an accidental detonation occurs. Such events have led to serious injury and death.

Blasting cap containment devices that are currently available can weigh in excess of 15 pounds and hold up to ten caps (see, for example, U.S. Pat. No. 4,347,929). The intent of these devices is to allow the transportation of blasting caps when in the vicinity of main explosives. Situations where this may occur are for teams confined to small boats or teams that transport main explosives and blasting caps within the same vehicle.

Personnel that conduct explosive operations often times transport blasting caps and main explosives within close proximity. The weight and burden of current blasting cap containment devices prevents personnel from carrying these systems for field operations where a small boat or vehicle is not present to transport the current blasting cap containment device. This limitation of the current system prevents tactical teams from using them. The size and weight of the devices as well as their inability to be adapted for explosive breaching operations, where an initiation system is attached, makes them a poor candidate for use.

In addition to transporting blasting caps, explosive ordnance personnel are required to transport enemy blasting caps and other enemy components during battlefield operations. The mission of the explosive ordnance disposal technician is to separate the explosive components of an enemy device in order to render the device safe. These operations consist of explosive ordnance disposal personnel removing blasting caps from bulk explosives as is common with roadside bombs, suicide vests, and other improvised explosive devices. Once the blasting cap is separated from the bulk explosive, the highly sensitive blasting cap is placed away from the bulk explosive in order to prevent a high order detonation. Many times, the explosive ordnance disposal technician explosively disposes of enemy blasting caps or other sensitive components that are unable to be transported back for intelligence gathering purposes. In these instances, potential enemy information is not obtained and an opportunity to collect and analyze the information is lost. This information could have been used in order to obtain fingerprints, DNA samples, lot numbers, and the country of origin, as well as other vital information that could potentially lead investigators to the bomb maker and supporting infrastructure.

Many similarities also exist between the materials that may be used for an explosive containment device, and modifying the configuration to direct explosive gases and fragmentation away from fragile components or personnel. As an example, explosive ordnance personnel routinely utilize explosives in order to disrupt improvised explosive devices (see, for example, U.S. Pat. No. 7,229,735 and U.S. Pat. No. 6,269,725). One drawback to utilizing these tools is that they cause collateral damage to the surrounding area and are unable to be fired from a robot. The ability to reduce the collateral damage of the disruption tools utilizing a combination of materials to direct, diffuse, and absorb the explosive gases and fragmentation would lessen the collateral damage inflicted by these tools and also makes it possible to fire explosive disruption tools from a terrestrial or waterborne response robot.

BRIEF SUMMARY OF THE INVENTION

Therefore, there is a need to manufacture personal blasting cap containment devices that are lightweight, compact, easy to use, and which meet the standards required in order to be classified as an explosive containment system. Such a blasting cap containment device includes a configuration for closing a blasting cap within the container, and a second configuration of the device must allow for an initiation system to be attached to the blasting cap. This configuration, although it allows explosive gases to escape during an incidental explosive incident would maximize the safety afforded an individual during tactical operations such as breaching, where transportation of a blasting cap with an initiation system attached is paramount.

Accordingly, a solution is needed that will not only provide the operator safety while transporting one or more explosive blasting caps, but may also be utilized in environments where weight, size, and ease of use are essential to mission success.

One embodiment of the present invention provides an explosive containment device that can contain the blast and fragmentation effects associated with the detonation of a blasting cap. While the explosive containment device used is designed to contain a specific NEW, similar containment devices can be used to transport homemade explosives, or other explosive materials, that are below or at the NEW threshold of the present invention. As an example, a explosive containment device that is able to withstand the explosive effects of a blasting cap that contains 0.24 grams of explosive compound (NEW=0.24 grams), then the explosive containment device may be utilized to transport explosive components, homemade explosives, precursors, or similar items that are at or below the 0.24 NEW threshold. This enables warfighters to gather explosive materials for exploitation and intelligence gathering.

It is also an objective of the present invention to provide a vented explosive containment device that is light in weight, portable in size relative to other explosive containment devices, and which can be used efficiently in order to remove the blasting caps for operational use with an initiation system attached.

It is a further objective of the present invention to provide a modular method and system of storing explosive containment devices within larger containers that are housed on a truck or small boat and then pulled from those larger containers as needed for field operations. Such a system may store up to 20, 30, 40, 50 or more blasting caps within an embodiment of the present invention that may be located on a tactical vehicle. Such a system would allow an individual operator the opportunity to remove one or more embodiments of the present inventions as required.

It is a further objective of the present invention to provide a system that utilizes foam based materials containing air pockets, or honeycombs, to disperse the explosive gases such that the container does not rupture. These same foam materials are also able to absorb energy (vice absorb shock) through the buckling or collapsing of the ligament structure. The energy absorbed is the result of material failure; the specific properties of the foam materials are depicted by its unique stress strain curve and are used to select appropriate foams. Unlike a shock absorber on a car which redirects and dampens the impulse force that results from the car hitting a speed bump in the road and maintains the car's stature, the foam materials used in the instant invention would absorb the impulse force by buckling the foam ligament structures, resulting in the car being lower to the ground. This buckling ability of foam materials, and the combination of diffusion of explosive gases, makes ligament structures that are present in foams ideal for explosive related energy absorption applications.

In the case of the present invention, the combination of foam materials, clapper plates, and clapper disks, which apply the loading to the ligament structure, enable the device to withstand powerful explosive events. While increasing the thickness of a pressure vessel wall may withstand similar blast pressures, this adds significant weight to the device. The combination of foam and clapper plates of the present invention reduces the overall weight of the device and ensures that the device is suitable for tactical operations, where weight decreases the effectiveness of the warfighter. As an example, one embodiment of the present invention which weighs less than 100 grams can accommodate a blasting cap with the net explosive weight, or TNT equivalency, of 0.24 grams and be safely detonated with minimum effects to the ambient environment.

It is still another objective of the present invention to provide material inserts that contact the explosive blasting caps in order to prevent them from being damaged during transportation and which translate kinetic energy to the ligament structure of the foam during an explosive event.

It is yet a further objective of the present invention to provide a foam insert and exterior container that can contain the blast and fragmentation of a single blasting cap and/or can be expanded and repeated in structural design in order to contain multiple numbers of blasting caps, such as may be the case for explosive operations where redundant initiation systems are required. As an example, a breacher that utilizes two blasting caps in order to conduct explosive operations may use a version of the present invention that enables two blasting caps to be stored in the same container, side by side, and which could be simultaneously or independently removed from the same container as shown in FIG. 1C.

It is yet a further objective of the present invention to provide a foam insert and exterior container that is modified in order to create a directional disruption tool. Typically, a directional disruption tool utilizes explosive gases in order to propel projectiles or liquid mediums to disrupt homemade bombs or improvised explosive devices. The configuration of the invention's blasting cap containment vessel is modified to direct the explosive gases toward a target in a single direction, or even be fitted to contain an explosively formed penetrator or shape charge. Such a tool is beneficial when placed on a terrestrial or maritime related robot because the channeling of the explosive gases and fragmentation would minimize the damage to the robot from which it was fired. This configuration of the invention is lightweight compared to current disruptors that utilize shotgun type technology. Additionally, the compact size enables the tool to be highly versatile and increases the disruption capabilities for dismounted warfighters who are prevented from carrying large disruption tools due to size and weight constraints.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE ILLUSTRATED EMBODIMENTS

Figure 1A:
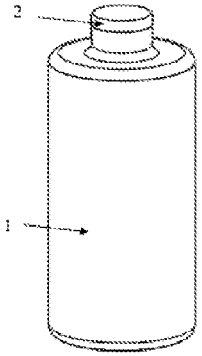
FIG. 1A is a perspective view of the explosive containment device 1 configured for containing the explosive blast and fragmentation of a blasting cap in accordance with one embodiment of the present invention.

The present invention will now be described in detail with reference to the accompanying drawings, wherein the same reference numerals will be used to identify the same or similar elements throughout the several views. It should be noted that the drawings should be viewed in the direction of orientation of the reference numerals.

Figure 1B:
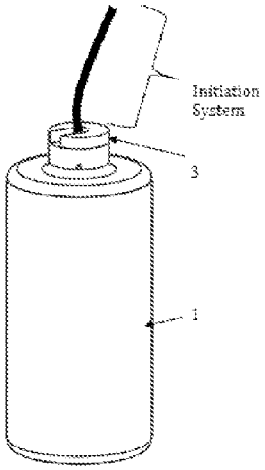
FIG. 1B is a perspective view of the explosive containment device 1 configured for minimizing the explosive blast and fragmentation of a blasting cap in accordance with one embodiment of the preset invention.

FIG. 1A illustrates an explosive containment device 1 that is configured as a non-vented blasting cap containment device with a threaded top lid 2. FIG. 1B illustrates an explosive containment device 1 configured as a vented blasting cap containment device with a grooved threaded top lid 3 containing a U-shaped opening. The grooved threaded top lid 3 enables the explosive containment device 1 to be used for inserting an initiation system as is common with tactical breaching operations. The grooved U-shaped opening is configured to encompass the center of the threaded top lid 3.

Figure 1C:
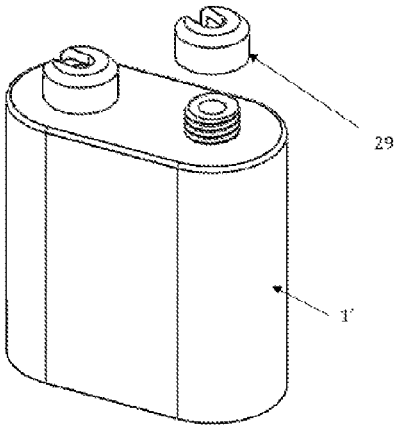
FIG. 1C is a perspective view of the explosive containment device 29 with external threads configured for minimizing the explosive blast and fragmentation of multiple blasting caps in accordance with one embodiment of the present invention.

FIG. 1C illustrates an explosive containment device 1 whose geometric patterns are replicated to create a multiple explosive containment device 29. FIG. 1C also illustrates the use of an optional internally threaded top lid 32 for embodiments of the present invention that may use external attachment mechanisms when mating onto the explosive containment device 1. The method of externally attaching a closing feature may also include detents, quick threads, or similar mechanical systems.

Figure 2:
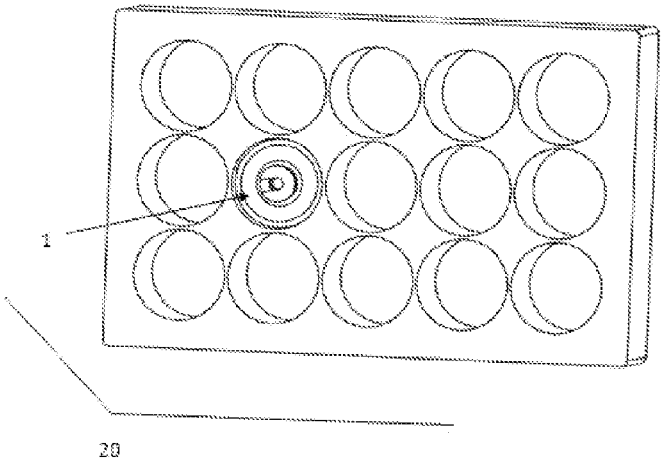
FIG. 2 is a perspective view of the explosive containment device 1 within a modular carrier system 20 in accordance with one embodiment of the present invention.

FIG. 2 is an illustration of an explosive containment device 1 inserted into a modular container 20. The utilization of a modular container 20, such as the one shown, enables numerous explosive containment devices 1 to be transported in larger containers. This method enables personnel to transport numerous explosive containment devices 1 within a tactical vehicle, small boat, helicopter, or similar platform and remove the number of explosive containment devices 1 that are required for an explosive application while affording the operator safety until removal of the blasting cap from the explosive containment device 1 is required. This ensures operator safety until the blasting cap is needed for priming main explosives.

Figure 3A:
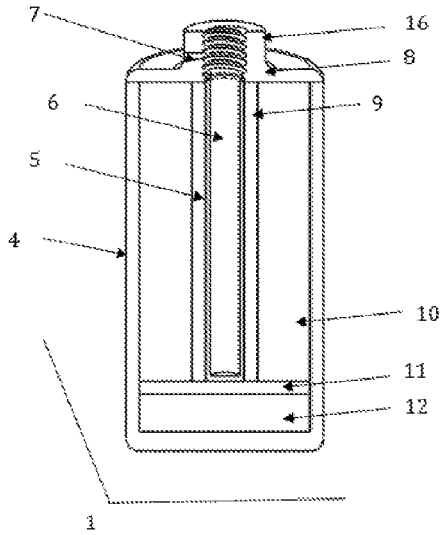
FIG. 3A is a cross-sectional view of the explosive containment device 1 in accordance with one embodiment of the present invention.
Figure 3B:
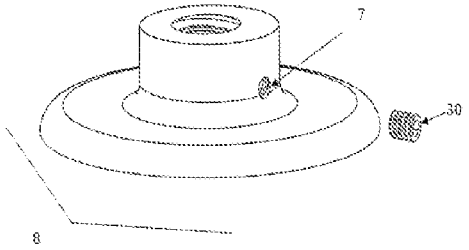
FIG. 3B is a perspective view showing the vent hole 7 and vent screw 30 located on the explosive containment device 1 in accordance with one embodiment of the present invention.

FIG. 3A and FIG. 3B show one embodiment of the current invention. The explosive containment device 1 includes an exterior container housing 4 closed at one end, an optional protective tube 5, an inner chamber 6, a vent screw 7, a set screw 7', a top cover 8, a clapper tube 9, a cylindrically tubed foam structure 10, a clapper disk 11, and a foam disk 12.

FIG. 3A shows the exterior container housing 4 of the explosive containment device 1 in accordance with an embodiment of the present invention. The exterior container housing 4 comprises an inner and outer walled housing. The housing is a cylindrical tube, and is closed on one end by a solid body of similar shape and on the other end by the top cover 8 which has an opening leading to the interior of the container. The exterior container housing 4 is made of high strength to weight ratio materials, which include, but are not limited to, carbon composites, metals and/or similar materials that may encapsulate blast pressure.

Located within the exterior container housing 4 on the closed end is the foam disk 12. The foam disk 12 is a cylindrical extruded body that has a radius nearly equivalent to the radius of the exterior container housing 4. The foam disk 12 is a porous material, honeycomb, or foam that is constructed out of carbon composites, metals, plastics, or other similar high strength materials, such as those available from ERG Aerospace, Oakland Calif. The foam disk 12 is used within the explosive containment device 1 in order to disperse the gases that are created during the initiation of an explosive material, to absorb the energy of the clapper disk 11 which is propelled away from the point of initiation, and to provide a light weight structural support system for the internal components of the explosive containment device 1.

The clapper disk 11 is located concentrically within the exterior container housing 4 and is inserted above the foam disk 12. The clapper disk 11 is a high strength material. The purpose of the clapper disk 11 is to absorb the forces of expanding gases in order to mechanically transfer the energy to the foam disk 12. The clapper disk 11 also redirects explosive gases throughout the cylindrically tubed foam structure 10. The clapper disk 11 also serves as a structural support member to the internal components of the explosive containment device 1.

FIG. 3A also shows the cylindrically tubed foam structure 10. The cylindrically tubed foam structure 10 is located concentrically within the exterior container housing 4 and is positioned on top of the clapper disk 11. The purpose of the cylindrically tubed foam structure 10 is to provide structural integrity for the components within the exterior container housing 4, disperse the explosive gases, and absorb the explosive energy that is translated through the clapper tube 9 after detonation. The foam structure 10 is made out of materials similar or identical to that of the foam disk 12.

The clapper tube 9 is located within the exterior container housing 4 of the explosive containment device 1 and concentric with the cylindrically tubed foam structure 10. The clapper tube 9 is also in contact with the top surface of the clapper disk 11 and may be interconnected to the clapper disk. The clapper tube 9 is a tubular metal, carbon composite or other similar high strength material. The purpose of the clapper tube 9 is to serve as the structural surface of the inner chamber 6, to provide a surface that may absorb explosive energy in order to translate that energy onto the cylindrically tubed foam structure 10, and to distribute expanding gases throughout the inner chamber 6. In some embodiments the clapper tube 9 is open at both ends. In some embodiments the clapper tube 9 has an optional flange at the open end in contact with the top cover 8.

Located concentrically and within the clapper tube 9 is the optional protective tube 5. The protective tube 5 is a rigid cylindrical tube with an internal and exterior wall. At one end of the cylindrical tube is an end cap that makes contact with the clapper disk 11. At the other end of the cylindrical tube is an optional lofted extrusion that seats the protective tube 5 against the top cover 8. The protective tube 5 is used to further protect the blasting cap from experiencing shock or friction within the inner chamber 6. For this reason, the protective tube 5 is made of polyethylene, rubber, or similar material that may absorb slight impulse energy in the event that the explosive containment device 1 is dropped.

Located on the top surface of the exterior container housing 4 is the top cover 8. The top cover 8 is a cylindrical disk that is flat on one surface. The opposite surface is also a flat surface, but in addition has a cylindrical extrusion 16 located concentrically with the disk edge. A hole penetrates through the cylindrical extrusion 16 as well as the cylindrical disk and communicates with the inner chamber 6. The top cover 8 contains the interior components within the exterior container housing 4, aligns the blasting cap within the protective tube 5 and inner chamber 6, and enables the inner chamber to be sealed. A vent hole 7 that leads to the inner chamber 6 can be included, which can be fitted with a vent screw 30. The top cover 8 may be made of the same or similar material that is used for the exterior container housing 4.

When present, the vent hole 7 is located on one surface of the cylindrical extrusion 16 of the top cover 8. The vent hole 7 is parallel to the surface of the top face of the disk. The vent hole 7 is a threaded hole into which a vent screw 30 inserts. The purpose of the vent hole 7 is to allow the operator the opportunity to equalize the pressure of the explosive containment device 1 during different pressure changes. As an example, the vent hole 7 may be opened and closed with varying altitudes that occur with air operations. An illustration of one configuration of the vent hole 7 and the vent screw 30 is shown in FIG. 3B.

Figure 4A:
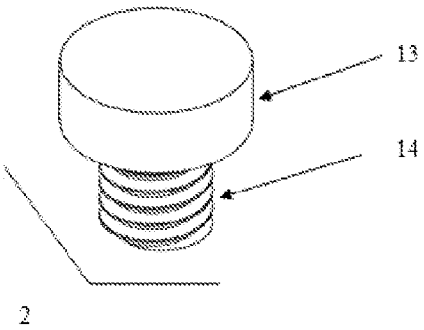
FIG. 4A is a perspective view of the threaded top lid 2 in accordance with one embodiment of the present invention.

FIG. 4A is one embodiment of a sealing device that may be mechanically attached to the top cover 8 of the explosive containment device 1 to configure the explosive containment device 1 as a encapsulated containment pressure vessel and to also prevent contaminants from entering the inner chamber 6. The threaded top lid 2 comprises an attachment mechanism 14 and a twist support 13. The threaded top lid 2 comprises a cylinder. On one surface of the cylindrical is a second cylinder of greater diameter. The diameter of the smaller of the two cylinders is equal to the diameter of the inner channel of the explosive containment device 1.

Figure 4B:
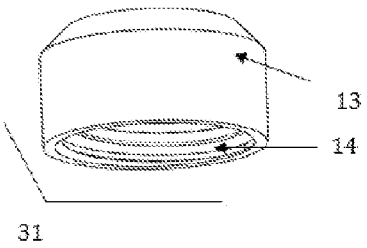
FIG. 4B is a perspective view of an internally threaded top lid 31 in accordance with one embodiment of the present invention.

FIG. 4B illustrates an optional internally threaded top lid 31 that may be used as a securing device on an explosive containment device 1 that utilizes external threads on the top cover 8. Like the threaded top lid 2, the external threaded top lid 31 comprises an attachment mechanism 14 and a twist support 13.

Figure 4C:
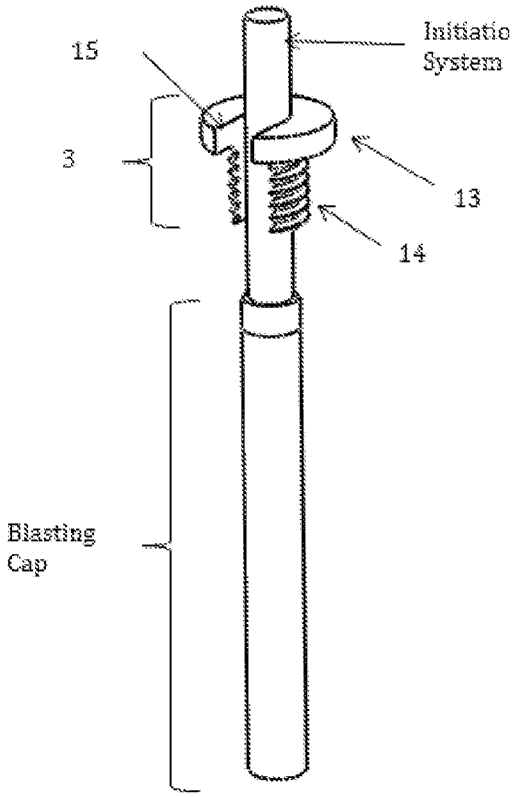
FIG. 4C is a perspective view of the grooved threaded top lid 3 being used with a blasting cap and initiation system in accordance with one embodiment of the present invention.
Figure 4D:
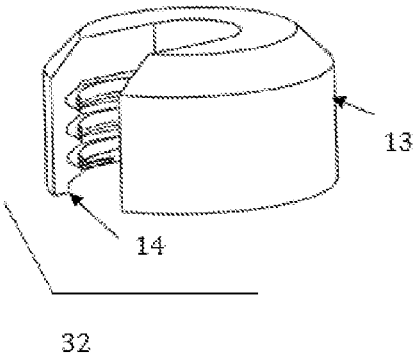
FIG. 4D is a perspective view of the internal grooved threaded top lid 32 in accordance with on embodiment of the present invention.

FIG. 4C is yet another embodiment of a sealing device that may be mechanically attached to the top cover 8 of the explosive containment device 1 to configure the explosive containment device 1 as a vented pressure vessel. The grooved threaded top lid 3 consists of the same features as the threaded top lid 2 with the addition of a cut groove 15. The cut groove 15 is a slotted clearance cut that extends through one side of the cylinder. The cut groove 15 extends through the entire length of the grooved threaded top lid 3. From the top view, the cut groove 15 is U shaped with a curved bottom portion. The radius of curvature of the curved bottom portion extends to the central axis of the grooved threaded top lid 3. The grooved threaded top lid 3 utilizes a twist support 13 and attachment mechanism 14 for internally threading to the top cover 8. The purpose of the groove 15 is to allow an initiation system to be secured within the explosive containment device 1 as illustrated.

Another embodiment of the sealing mechanism of the current device includes the mechanical modification of the closure. The system presented in the Figures includes a thread. Yet the enclosure can be modified to include the use of mechanical detents, mechanical locks, and numerous other mechanical mechanisms, without compromise to the core functionality of the present invention. Such a modification may be the use of external threads on the top cover 8. Here, an internal grooved threaded top lid 32 may be utilized. The internal grooved threaded top lid 32 has a cut groove 15, a attachment mechanism 14 and a twist support. The purpose of the internal grooved threaded top lid 32 is similar to the grooved threaded top lid 3 with the exception that it fastens to an externally threaded top cover 8.

In one embodiment of the present invention, the explosive containment device 1 can be used when compact, lightweight, and easy to use systems are required for transporting blasting caps or similar explosives. In one embodiment of the present invention, the weight of the explosive containment device 1 is below 2300 grams, preferably below 450 grams, and further preferably below 80 grams or lower. In addition, the geometry of the system can be replicated in order to support the explosive containment of more than one blasting cap. Such applications may be advantageous for personnel who utilize dual primed explosive breaching systems. Other embodiments are directed to use by personnel who carry two, three, or more blasting caps for field operations as shown, for example, in FIG. 1C.

In another embodiment of the present invention, the explosive containment device 1 may be modified to be a vented fragmentation sleeve or used to barricade an electric blasting cap when the initiation system of the blasting cap are being extended and attached to an electrical firing system as shown in FIG. 1B.

In yet another embodiment of the present invention, the explosive containment device 1 may be utilized to contain other explosive or hazardous materials within the inner chamber 6. Forensic collection of homemade explosives, squibs, explosive precursors and .50 caliber cartridges are examples of items that also use configurations of the present invention.

In another embodiment of the present invention, the explosive containment device 1 is modified to be an explosive disruption device 19. The unique features of foam structure to diffuse explosive gases and absorb energy through the ligaments of the foam make it possible to utilize the present invention as a system that expels a medium, such as water or an explosively formed penetrator, to disrupt hazardous devices or improvised explosive devices.

Figure 5:
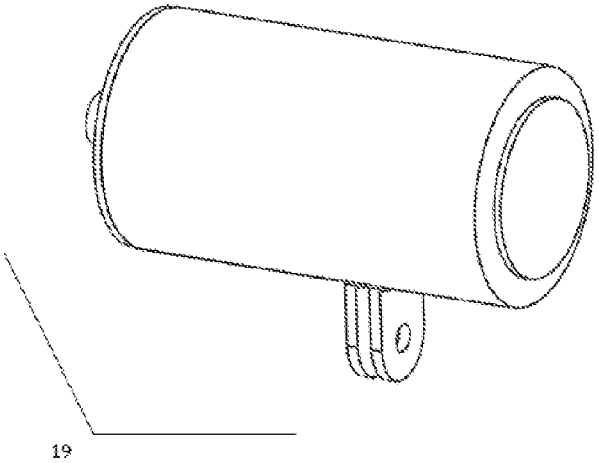
FIG. 5 is a perspective view of the disruption device 19 in accordance with another embodiment of the present invention.

FIG. 5 illustrates one embodiment of the directional disruptor 19.

Figure 6:
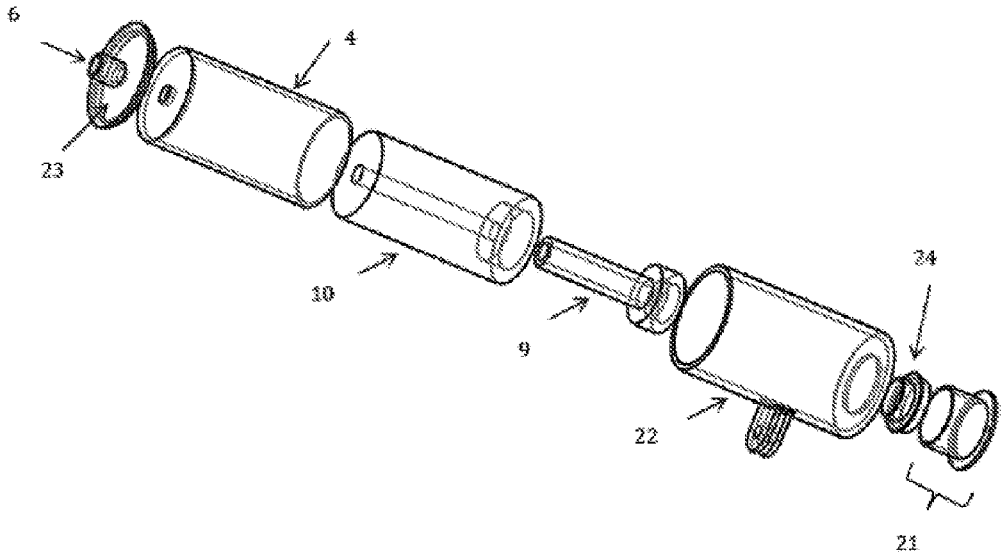
FIG. 6 is a perspective view of the components of the disruption device 19 in accordance with another embodiment of the present invention.

FIG. 6 illustrates the components of one embodiment of the directional disruptor 19. The directional disruptor 19 uses similar components to those used in the explosive containment device 1, but configures these components to control and direct the expansion of gases and energy vice encapsulating the fragmentation and blast pressure. The directional disruptor 19 includes an exterior container housing 4, inner chamber 6, clapper tube 9, and foam structure 10. The function and presence of each of these components is similar to that described for the explosive containment device 1, but in some cases may be slightly modified in order to obtain the desired result.

The most significant modification that is made to create the directional disruptor 19 is to open one end of the exterior container housing 4 that is used for the explosive containment device 1. While the explosive containment device 1 utilizes an exterior container housing 4 that consists of a cylindrical tube closed at one end and with an end cap at the opposite end, the directional disruptor 19 is open at both ends with a single end cap. The purpose of the exterior container housing 4 for the directional disruptor 19 remains the same; that is, to prevent explosive blast pressure and fragmentation from penetrating the cylinder walls and end cap and to serve as a stationary wall for the ligament foam structures to collapse against.

The inner chamber 6, foam structure 10, and clapper tube 9 function as in the explosive containment device 1. In some embodiments the clapper tube 9 includes a thick flange or additional cylinder wall at one end of the tube. This serves to encapsulate the point of initiation of the directional disruptor 19, which takes place at the projectile top lid 24.

The directional disruptor 19, may comprise additional components in order to mount the system onto a robot and to enable the device to fire a projectile, shape charge, or water.

FIG. 6 illustrates additional components that may be used for a directional disruption device. These include a projectile container 21, disruptor housing 22, disruptor top 23, and a projectile top lid 24. Of these, the disruptor top 21 and disruptor housing 22 allow for the directional disruptor 19 to be mounted and fired from a robot or firing stand and are therefore constructed of lightweight plastics or composites. When assembled, the disruptor top 21 and disruptor housing 22 contain the internal components of the directional disruptor 19. The disruptor housing 22 is a cylindrical tube with inner and outer walls which allow for the insertion of the foam structure 10, and clapper tube 9, and exterior container housing 4. One end of the disruptor housing 22 is partially closed in order to allow the insertion of the projectile container 21. The disruptor top 21 is attached to the opposite end of the disruptor housing 22. Much like the top cover 8 for the explosive containment device 1, the disruptor top 21 consists of an external cylindrical extrusion that enables the blasting cap to be inserted into the inner chamber 6.

While the disruptor housing 22 and disruptor top 23 are used for mounting the directional disruptor and containing the internal components, the projectile container 21 and projectile top lid 24 are used for delivering a projectile, shape charge, or water to an intended target. The projectile top lid 24 and projectile container 21 are made of lightweight plastics of composites, and provide for a watertight attachment to the disruptor housing 22 when placed into position. This is essential for maritime related operations and underwater disruption or neutralization operations.

Figure 7:
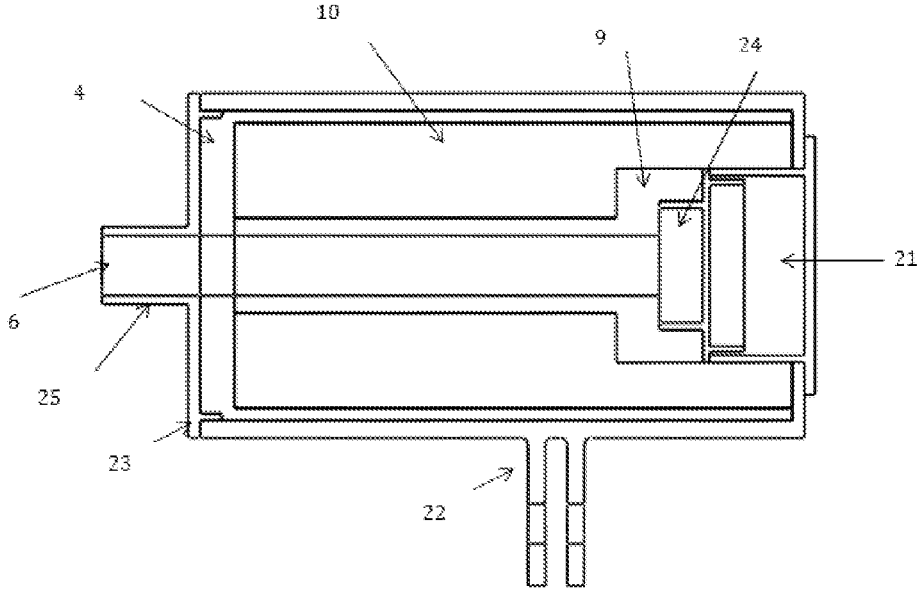
FIG. 7 is a cross sectional view of the disruption device 19 in accordance with one embodiment of the present invention.

FIG. 7 is a cross sectional illustration of one embodiment that shows the location of the components when inserted and enclosed within the disruptor housing 22 and disruptor top 23. FIG. 7 also illustrates the disruptor top lid extrusion 25. This feature is similar to the top cover 8 of the explosive containment device 1 in that it serves as the location for securing the initiation system or blasting cap into position. Simply utilizing the side of the disruptor top lid extrusion 25 as an anchoring point for tape suffices for terrestrial applications. More extravagant mechanical connection systems may be optional for maritime applications.

Figure 8:
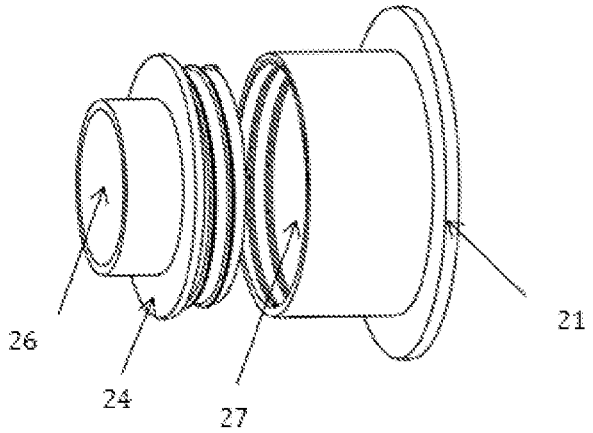
FIG. 8 is a perspective view of the projectile container 21 and the projectile top lid 24 in accordance with the embodiment of the present invention.

FIG. 8 illustrates an embodiment where the projectile container 21 and the projectile top lid 24 are configured for use with a water disruption shot. The projectile container 21 is a cylindrical hollow body housing with an internal projectile container cavity 27 that consists of an inner and outer wall. One end of the projectile container cavity 27 is enclosed in order to enable the projectile container 21 to hold fluids or explosive tools such as explosively formed penetrators and shape charges. When filled with the tool of choice, the projectile top lid 24 is mechanically fastened to the projectile container and creates a water tight fit. Once the projectile top lid 24 is connected, sheet explosives or similar bulk explosives are inserted into the projectile top lid cavity 26. The projectile top lid cavity 26, projectile container 21, and projectile top lid 24 insert into the directional disruptor 19 as shown in FIG. 7.

Figure 9:
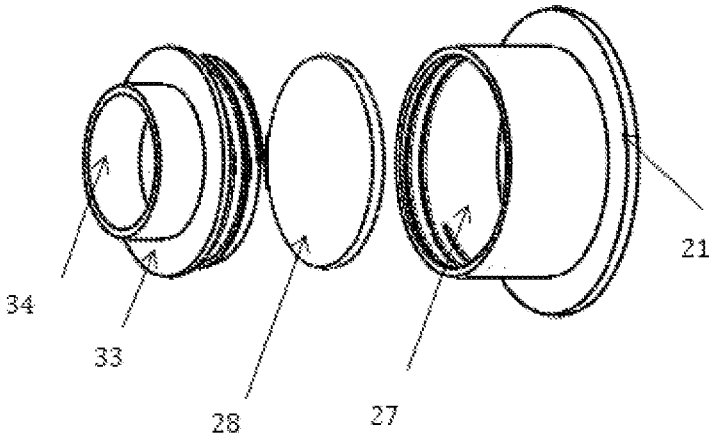
FIG. 9 is a perspective view of the modified projectile top lid 33 that may be used for alternate projectiles such as explosively formed penetrators in accordance with the embodiment of the present invention.

FIG. 9 illustrates an embodiment of a modified top lid cavity 34 and modified projectile top lid 33 that are used to enable the use of bulk explosives within the projectile container cavity 27. The modified top lid cavity 34 is removed and the hollow modified projectile top lid 33 allows for a blasting cap to fit into the projectile container cavity 27 when assembled. This type of arrangement may be used for firing explosive formed penetrators 28 or similar shape charges from the directional disruptor 19.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

Operation of Device

The configurations of the illustrated explosive containment device 1 are intended to contain the fragmentation and blast effects of explosives, such as a blasting cap.

Some embodiments of the explosive containment device 1 are intended to be used as a complete encapsulation device or a vented device. For example, the encapsulation of a blasting cap is beneficial for transporting and storing blasting caps and is possible using the threaded top lid 2. The vented configuration of the explosive containment device 1 is beneficial for operational applications where the initiation system is attached to the blasting cap or where the blasting cap is an electrical blasting cap that has leg wires. This configuration of the explosive containment device 1 is possible, for example, utilizing the grooved threaded top lid 3.

In order to utilize the explosive containment device 1 with the threaded top lid 2, the operator simply inserts a blasting cap or other similar explosive material within the inner chamber 6 of the explosive containment device 1. Once completed, the operator attaches the threaded top lid 2 onto the explosive containment device 1.

Upon inserting the blasting cap or similar explosive material within the inner chamber 6, the blasting cap or explosive is prepared for transportation or storage. In the event of a detonation, the explosive event within the inner chamber 6 emits heat, pressure, and fragmentation. Significant kinetic energy is propelled to the clapper tube 9 and clapper disk 11.

In order to contain the explosive event, substantial absorption and diffusion of kinetic energy is required. As is the case of mechanical absorption, the mechanical energy applied to the clapper tube 9 upon detonation is translated onto the foam structure 10. The buckling of the foam structure 10 between the clapper tube 9 and the exterior container housing 4 absorbs significant amounts of the kinetic energy associated with the blast. The buckling of the foam structure 10 is a predictable and controllable attribute of the foam structure 10 that may be designed utilizing standard stress-strain curves for the material type or alloy. Similar mechanical energy absorption occurs on the foam disk 12 when the clapper disk 11 is projected away from the explosive detonation.

Another capability of the present invention is the ability of the device to diffuse the explosive gases. The foam structure 10 and foam disk 12 are utilized to accomplish diffusion. By dispersing and slowing down the explosive gases through the foam structure 10 and foam disk 12, the impulse energy is controlled and dispersed throughout the interior of the exterior container housing 4. Without the foam structure 10 and the foam disk 12, the impulse energy would be focused on the exterior container housing 4 at the closest distance to the origin of the explosive event and the impulse force would either cause deformation that exceeds plastic deformation, or make the design configuration of the exterior container housing 4 such that the wall thickness would be able to withstand such an impulse. Doing the later would result in additional weight to the system.

Fragmentation and heat are also byproducts of most explosive events. For example, due to the fact that blasting caps are usually constructed of light alloys such as aluminum, the result is that fragmentation particles of the blasting cap melt and become brazed to the clapper plate 9 and clapper disk 11. In the event that fragmentation is of a different alloy or if the particles of fragmentation are projected beyond the clapper disk 11 and clapper tube 9, then the foam structure 10 and foam disk 12 absorb the energetic fragments much in the same way as they absorb the energy of the clapper plate 9 and clapper disk 11 as explained above. While fragmentation has been shown to be contained within the explosive containment device 1, the heat associated with the detonation of explosive is also significant. Numerous solutions to reducing the heat exist and include such methods as exterior handling covers, internal phase change materials, and other routine heat reduction techniques.

Much like the operation of the explosive containment device 1, the directional disruptor 19 utilizes similar combinations of materials in order to reduce the explosive energy and results in a disruption tool that projects a fluid medium or projectile in a single direction while minimizing collateral damage along the other directional axes.

To utilize the directional disruptor 19, the operator inserts water, or a similar fluid medium, into the projectile container cavity 27, and secures the projectile top lid 24 onto the projectile container 21. The projectile container 21 and projectile top lid 24 are then inserted into the directional disruptor 19 and pushed into place until they make contact with the clapper tube 9. As an option, the operator may choose to add additional explosive composition onto the top of the projectile top lid 24 in order to increase the explosive power of the directional disruptor 19 for hardened targets such as metal containers. This may be done by inserting explosives into the projectile top lid cavity 26.

Once loaded with the projectile container 21, the operator then inserts the blasting cap into the inner chamber 6 and pushes the blasting cap until it makes contact with the projectile top lid 24 or explosives located on the projectile top lid cavity 26. The blasting cap may then be secured into position by taping the initiation system to the disruptor top lid extrusion 25. Once the blasting cap is secured into position, the directional disruptor 19 may be attached to a robot or firing stand via the mount 22.

Upon the controlled detonation of the directional disruptor 19, the explosive energy associated with the detonation acts much like that of the explosive containment device 1. Blast pressure from the clapper tube 9 is transferred to the foam structure 10, where the buckling of the foam structure 10 occurs between the clapper tube 9 and the exterior container housing 4. This results in energy absorption, and directs the explosive energy along the path of least resistance; that is, along the intended path towards the target.

As is the case with the explosive containment device 1, the directional disruptor 19 may also utilize different configurations of materials and foam structures, but ideally use lightweight foam structures and lightweight metal alloys such as titanium to reduce the weight to levels appropriate to robotic operations.

What is claimed is:

1. An explosive container, comprising:

a housing having an interior chamber;

at least one securing mechanism configured to seal the interior chamber of the housing, wherein the securing mechanism includes a cut-out portion so as to create a vented pressure vessel configured to support an initiation system;

a high strength absorber placed within the interior chamber of the housing and configured to absorb fragmentation, diffuse gases, absorb energy, and support at least one blasting cap or explosive;

a disruptor housing accommodating the explosive container; and a clapper member having a hollow portion disposed within the interior chamber of the housing, the hollow portion forming an inner chamber configured to receive the at least one blasting cap or explosive, wherein the clapper member is surrounded by the high strength absorber and is configured to mechanically transfer fragmentation, gases and energy generated from the inner chamber during an explosion of the blasting cap or explosive to the high strength absorber and wherein the weight of the explosive container is less than 2300 g.

2. The explosive container of claim 1, further comprising at least one protective tube placed within the hollow portion of the clapper member to support the at least one blasting cap or explosive.

3. The explosive container of claim 1, wherein the high strength absorber comprises a tubular portion with a hollow portion concentrically accommodating the clapper member.

4. The explosive container of claim 1, wherein the high strength absorber further comprises a disk portion positioned below the clapper member at one end of the housing.

5. The explosive container of claim 1, wherein the high strength absorber is made of foam metal or high strength carbon.

6. The explosive container of claim 5, wherein the foam metal is titanium or stainless steel or high strength carbon.

7. The explosive container of claim 1, wherein the securing mechanism comprises a threaded component, or a detent or a fastener.

8. The explosive container of claim 1, wherein the securing mechanism creates an encapsulated pressure vessel.

9. The explosive container of claim 1, wherein the securing mechanism includes a sealable opening leading to the inner chamber.

10. A method of operating the explosive container of claim 1, comprising the steps of:

placing a high strength absorber within an interior chamber of the explosive container to absorb fragmentation, diffuse gases, and absorb energy;

placing a clapper member within the interior chamber and concentrically surrounded by the high strength absorber, the clapper member including a hollow portion forming an inner chamber;

inserting a blasting cap or explosive into the inner chamber, wherein the step of inserting the blasting cap or explosive uses a stationary securing device as a guide such that the blasting cap or explosive and the stationary securing device are aligned; and engaging a securing device with the stationary securing device into a closed position such that an initiation system is surrounded by the stationary securing device.

11. The method of operating an explosive container of claim 10, further comprising the step of inserting the blasting cap or explosive into a protective tube configured to support the blasting cap or explosive, before the step of inserting the protective tube containing the blasting cap or explosive into the inner chamber.

12. A blasting cap or explosive storage system, comprising:

a modular container; and a plurality of explosive containers positioned within the modular container for containing a plurality of blasting caps or explosives, wherein each explosive container comprises a housing having an interior chamber;

a high strength absorber placed within the interior chamber of the housing and configured to absorb fragmentation, diffuse gases, absorb energy, and support at least one blasting cap or explosive; and a clapper member having a hollow portion disposed within the interior chamber of the housing, the hollow portion forming an inner chamber configured to receive the at least one blasting cap or explosive, and wherein the clapper member is surrounded by the high strength absorber and is configured to mechanically transfer fragmentation, gases and energy generated from the inner chamber during an explosion of the blasting cap or explosive to the high strength absorber, and wherein the modular container is configured to be transportable in a vehicle and each of the plurality of the explosive container is capable of being individually pulled out from the modular container for operation.

13. A method of using the explosive storage system of claim 12, comprising:

removing an explosive container from the storage system that contains numerous explosive containers.

14. A unidirectional explosive disruption device, comprising:

an explosive container, comprising:

a housing having an interior chamber;

a high strength absorber placed within the interior chamber of the housing and configured to absorb fragmentation, diffuse gases, absorb energy, and support at least one blasting cap or explosive; and a clapper member having a hollow portion disposed within the interior chamber of the housing, the hollow portion forming an inner chamber configured to receive the at least one blasting cap or explosive, wherein the clapper member is surrounded by the high strength absorber and is configured to mechanically transfer fragmentation, gases and energy generated from the inner chamber during an explosion of the blasting cap or explosive to the high strength absorber; and a projectile container received within the explosive container at one end of thereof, the projectile container being concentrically connected to the inner chamber and surrounded by the high strength absorber.

15. The unidirectional explosive disruption device of claim 14, wherein the projectile container comprises:

a body having a cavity; and a lid attached to the body and configured to provide a watertight seal.

16. The unidirectional explosive disruption device of claim 15, wherein the clapper member includes a tubular extension configured to accommodate the lid of the projectile container.

17. The unidirectional explosive disruption device of claim 15, wherein the lid includes a hollow portion communicating to the inner chamber, so that the at least one blasting cap or explosive can extend to the cavity of the body.

* * * * *